US010801489B2

(12) United States Patent
Mou et al.

(10) Patent No.: US 10,801,489 B2
(45) Date of Patent: Oct. 13, 2020

(54) GAS TRANSPORTATION DEVICE

(71) Applicant: Microjet Technology Co., Ltd., Hsinchu (TW)

(72) Inventors: Hao-Jan Mou, Hsinchu (TW); Shih-Chang Chen, Hsinchu (TW); Jia-Yu Liao, Hsinchu (TW); Hung-Hsin Liao, Hsinchu (TW); Shou-Hung Chen, Hsinchu (TW); Chi-Feng Huang, Hsinchu (TW); Chang-Yen Tsai, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 134 days.

(21) Appl. No.: 16/124,562

(22) Filed: Sep. 7, 2018

(65) Prior Publication Data

US 2019/0128252 A1 May 2, 2019

(30) Foreign Application Priority Data

Oct. 27, 2017 (TW) ..... 106137195 A

(51) Int. Cl.
*F04B 45/047* (2006.01)
*F04B 39/12* (2006.01)

(52) U.S. Cl.
CPC ..... *F04B 45/047* (2013.01); *F04B 39/121* (2013.01); *F04B 39/123* (2013.01)

(58) Field of Classification Search
CPC ..... F04B 41/06; F04B 43/00; F04B 43/0009; F04B 43/0018; F04B 43/0027;
(Continued)

(56) References Cited

U.S. PATENT DOCUMENTS

2009/0148320 A1* 6/2009 Lucas ..... F04B 43/046 417/481
2017/0222123 A1 8/2017 Chen et al.
(Continued)

FOREIGN PATENT DOCUMENTS

CN 101328879 A 12/2008
CN 206477983 U 9/2017
(Continued)

OTHER PUBLICATIONS

Indian Office Action dated Apr. 27, 2020 for Application No. 201824033747 with an English translation.

*Primary Examiner* — Patrick Hamo
*Assistant Examiner* — Chirag Jariwala
(74) *Attorney, Agent, or Firm* — Birch, Stewart, Kolasch & Birch, LLP

(57) ABSTRACT

A gas transportation device includes a gas outlet cover, at least one flow-guiding pedestal, a primary gas pump, a secondary gas pump and an adhesive film. The gas outlet cover includes a gas outlet nozzle and a gas outlet cavity. Each flow-guiding pedestal includes a main plate, a protruding frame and a chamber frame. The main plate includes a recess and a communicating aperture. The primary gas pump is disposed in the protruding frame, and the secondary gas pump is disposed in the chamber frame. The adhesive film has a hollow structure, is disposed between the primary gas pump and the flow-guiding pedestal and defines a convergence chamber. Consequently, the gas is introduced into the recess, transported to the primary gas pump through the communicating apertures and the convergence chamber, transported to the gas outlet cavity via the primary gas pump, and finally discharged out from the gas outlet nozzle.

7 Claims, 12 Drawing Sheets

(58) Field of Classification Search
CPC .. F04B 43/0054; F04B 43/025; F04B 43/026; F04B 43/046; F04B 45/04; F04B 45/043; F04B 45/045; F04B 45/10; F04B 45/07
USPC ..... 417/413.2
See application file for complete search history.

(56) References Cited

U.S. PATENT DOCUMENTS

| | | | | |
|---|---|---|---|---|
| 2018/0051686 | A1* | 2/2018 | Tanaka | F04B 9/02 |
| 2018/0066650 | A1* | 3/2018 | Fujisaki | F02B 43/02 |
| 2018/0209412 | A1* | 7/2018 | Wei | F04B 43/046 |

FOREIGN PATENT DOCUMENTS

| | | | | |
|---|---|---|---|---|
| EP | 2 835 535 | A1 | 2/2015 | |
| EP | 2 998 582 | A1 | 3/2016 | |
| EP | 3 203 076 | A1 | 8/2017 | |
| JP | 2011241808 | A * | 12/2011 | |
| WO | WO-2017059660 | A1 * | 4/2017 | F04B 45/047 |

* cited by examiner

GAS TRANSPORTATION DEVICE

FIELD OF THE INVENTION

The present disclosure relates to a gas transportation device, and more particularly to a miniature and silent gas transportation device for transporting gas at high pressure.

BACKGROUND OF THE INVENTION

Nowadays, in various fields such as pharmaceutical industries, computer techniques, printing industries or energy industries, the products are developed toward elaboration and miniaturization. The gas transportation devices are important components that are used in micro pumps. Therefore, how to utilize an innovative structure to break through the bottleneck of the prior art has become an important part of development.

With the rapid development of science and technology, the applications of gas transportation devices are becoming more and more diversified. For example, gas transportation devices are gradually popular in industrial applications, biomedical applications, medical care applications, electronic cooling applications and so on, or even the wearable devices. It is obvious that the gas transportation devices gradually tend to miniaturize the structure and maximize the flow rate thereof.

In accordance with the existing technologies, the gas transportation device is assembled by stacking plural conventional mechanical parts. For achieving the miniature and slim benefits of the overall device, all mechanical parts are minimized or thinned. However, since the individual mechanical part is minimized, it is difficult to the control the size precision and the assembling precision. Consequently, the product yield is low and inconsistent, or even the flowrate of the gas is not stable.

Moreover, there are also issues associated with insufficient pressure for transporting the gas by any conventional gas transportation device. Therefore, the requirement of transporting gas at high pressure cannot be satisfied by single gas transportation device. Therefore, there is a need of providing a gas transportation device to increase pressure for gas transportation.

SUMMARY OF THE INVENTION

An object of the present disclosure provides a gas transportation device. The miniature gas pumps of the gas transportation device are stacked on each other, so as to achieve the efficacy of transporting gas at high pressure.

In accordance with an aspect of the present disclosure, a gas transportation device is provided. The gas transportation device includes a gas outlet cover, at least one flow-guiding pedestal, a primary gas pump, a secondary gas pump and an adhesive film. The gas outlet cover includes a gas outlet nozzle and a gas outlet cavity. The gas outlet nozzle and the gas outlet cavity are in communication with and spatially corresponding to each other. Each flow-guiding pedestal includes a main plate, a protruding frame and a chamber frame. The main plate has a recess and a communicating aperture in communication with the recess. The primary gas pump is disposed in the protruding frame of the flow-guiding pedestal, and the secondary gas pump is disposed in the chamber frame of the flow-guiding pedestal. The adhesive film has a hollow structure and is disposed between the primary gas pump and the flow-guiding pedestal, wherein the hollow structure defines a convergence chamber in communication with the communicating aperture. The gas outlet cover covers and seals the flow-guiding pedestal, and the gas outlet cover is connected and sealed with the protruding frame of the flow-guiding pedestal up and down. While the primary gas pump and the secondary gas pump are enabled to transport gas simultaneously, the gas is introduced into the recess of the flow-guiding pedestal, is transported to the primary gas pump through the communicating aperture and the convergence chamber sequentially, is transported to the gas outlet cavity via the primary gas pump, and finally is discharged out from the gas outlet nozzle.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

Figure 1A:
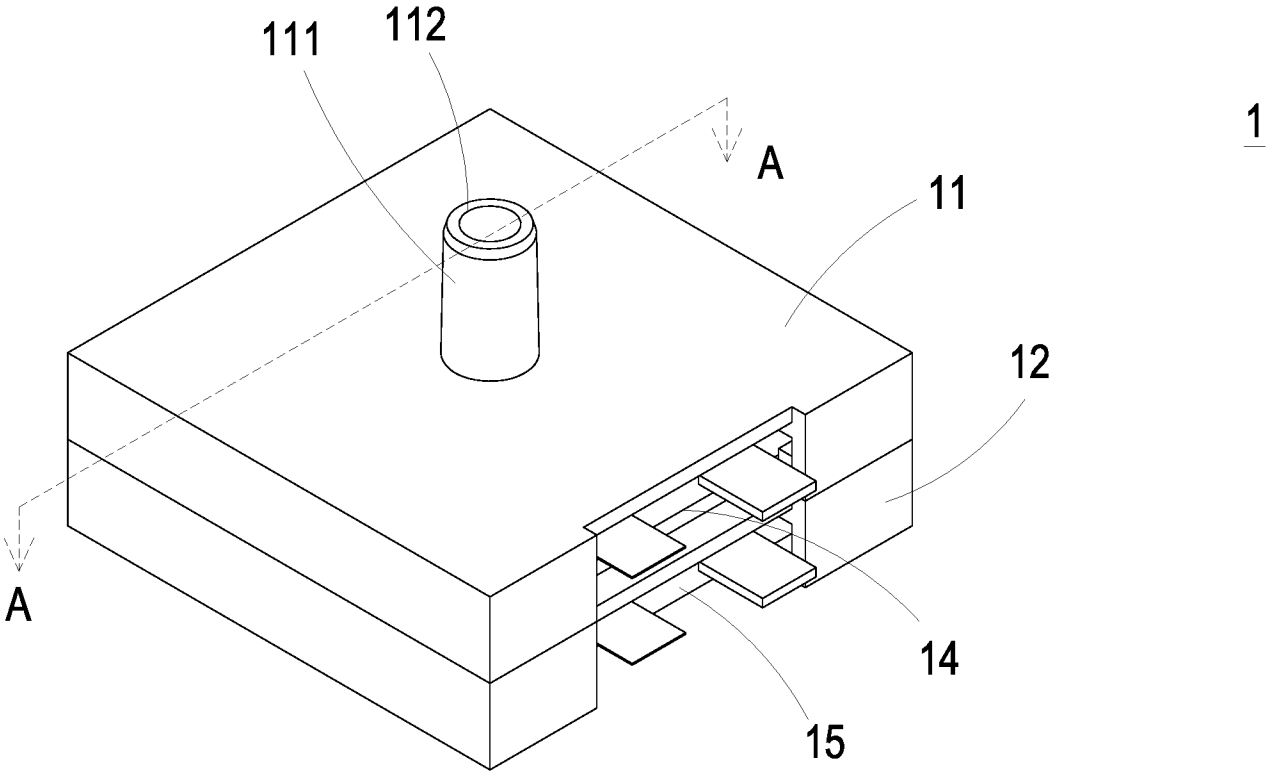
FIG. 1A is a schematic perspective view illustrating the gas transportation device according to an embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Please refer to FIGS. 1A to 3B. The present discourse provides a gas transportation device including at least one gas outlet cover 11, at least one gas outlet nozzle 111, at least one gas outlet cavity 114, plural flow-guiding pedestals 12, at least one main plate 120, at least one protruding frame 121, at least one chamber frame 122, at least one recess 124, at least one communicating aperture 125, at least one primary gas pump 14, at least one secondary gas pump 15, at least one adhesive film 13, at least one hollow structure and at least one convergence cavity 141*c*. The number of the outlet cover 11, the gas outlet nozzle 111, the gas outlet cavity 114, the main plate 120, the protruding frame 121, the chamber frame 122, the recess 124, the communicating aperture 125, the primary gas pump 14, the hollow structure and the convergence cavity 141*c* is exemplified by one for each in the following embodiments but not limited thereto. It is noted that each of the outlet cover 11, the gas outlet nozzle 111, the gas outlet cavity 114, the main plate 120, the protruding frame 121, the chamber frame 122, the recess 124, the communicating aperture 125, the primary gas pump 14, the hollow structure and the convergence cavity 141*c* can also be provided in plural numbers.

The gas transportation device of the present disclosure is applicable to various electronic devices and medical apparatuses for increasing the amount of the gas to be transported. Please refer to FIGS. 1A, 1B, 2A, 2B, 3A, 3B and 4. The gas transportation device 1 includes a gas outlet cover 11, at least one flow-guiding pedestal 12, a primary gas pump 14, at least one secondary gas pump 15 and an adhesive film 13. The gas outlet cover 11, the primary gas pump 14, the adhesive film 13, the flow-guiding pedestal 12 and the secondary gas pump 15 are stacked on each other sequentially in vertical direction. In other words, the primary gas pump 14 is disposed in a protruding frame 121 of the flow-guiding pedestal 12, and the secondary gas pump 15 is disposed in a chamber frame 122 of the flow-guiding pedestal 12. The gas outlet cover 11 covers and seals the flow-guiding pedestal 12. The primary gas pump 14 and the secondary gas pump 15 are used for transporting the gas. While the primary gas pump 14 and the secondary gas pump 15 are enabled to transport the gas simultaneously, the gas is transported and converged through the gas outlet cover 11 and the flow-guiding pedestal 12, and is rapidly discharged out from a gas outlet nozzle 111 of the gas outlet cover 11. Consequently, the efficacy of increasing the amount of the gas to be transported is achieved. For describing the technical content of the present disclosure, the detailed structures and the actions of the gas transportation device 1 are further described in the following paragraphs.

Figure 2A:
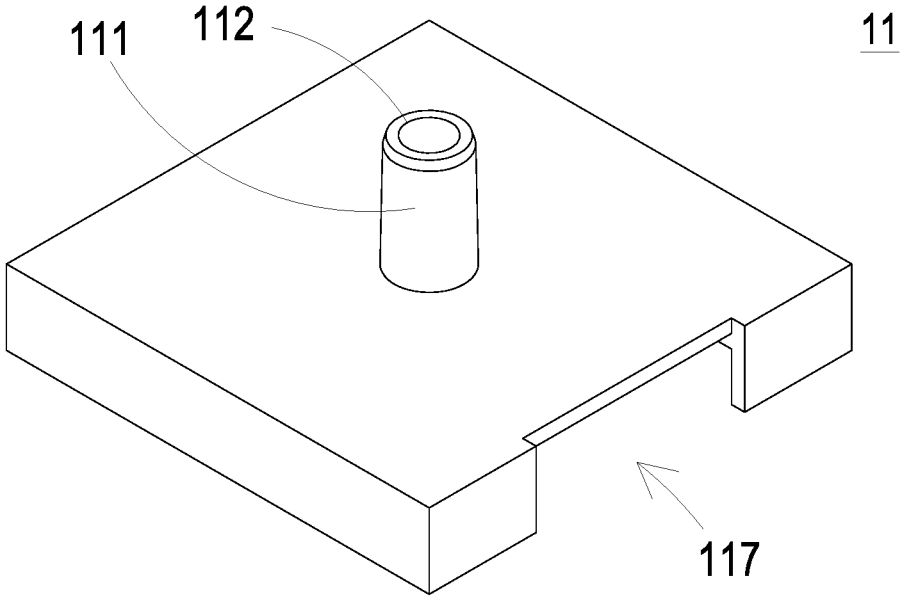
FIG. 2A is a schematic perspective view illustrating the gas outlet cover of FIG. 1B and taken along a front side.
Figure 2B:
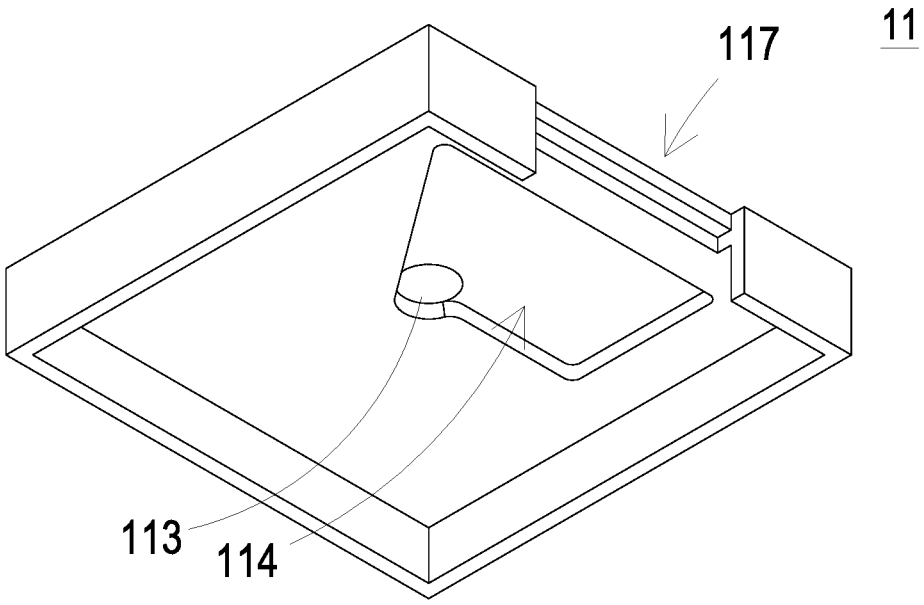
FIG. 2B is a schematic perspective view illustrating the gas outlet cover of FIG. 2A and taken along the rear side.

Please refer to FIGS. 2A and 2B. In this embodiment, the gas outlet cover 11 includes the gas outlet nozzle 111 and a gas outlet cavity 114. The gas outlet nozzle 111 and the gas outlet cavity 114 are in communication with and spatially corresponding to each other. The gas outlet nozzle 111 has a discharging opening 112, and the gas outlet cavity 114 has an inlet opening 113. The discharging opening 112 is disposed in the gas outlet nozzle 111 and is in communication with the inlet opening 113 of the gas outlet cavity 114. A diameter of the inlet opening 113 of the gas outlet cavity 114 is larger than a diameter of the discharging opening 112 of the gas outlet nozzle 111. More specifically, the gas outlet nozzle 111 is designed in a conical shape that the gas outlet nozzle 111 is gradually tapered from the inlet opening 113 to the discharging opening 112, but not limited thereto. Accordingly, the gas outlet nozzle 111 has diameters which are gradually decreased from the inlet opening 113 to the discharging opening 112. Owing to the conical shape of the gas outlet nozzle 111, the gas can be effectively converged and then be rapidly transported by the gas outlet nozzle 111. In this embodiment, the gas outlet cover 11 has a pin opening 117.

Figure 3A:
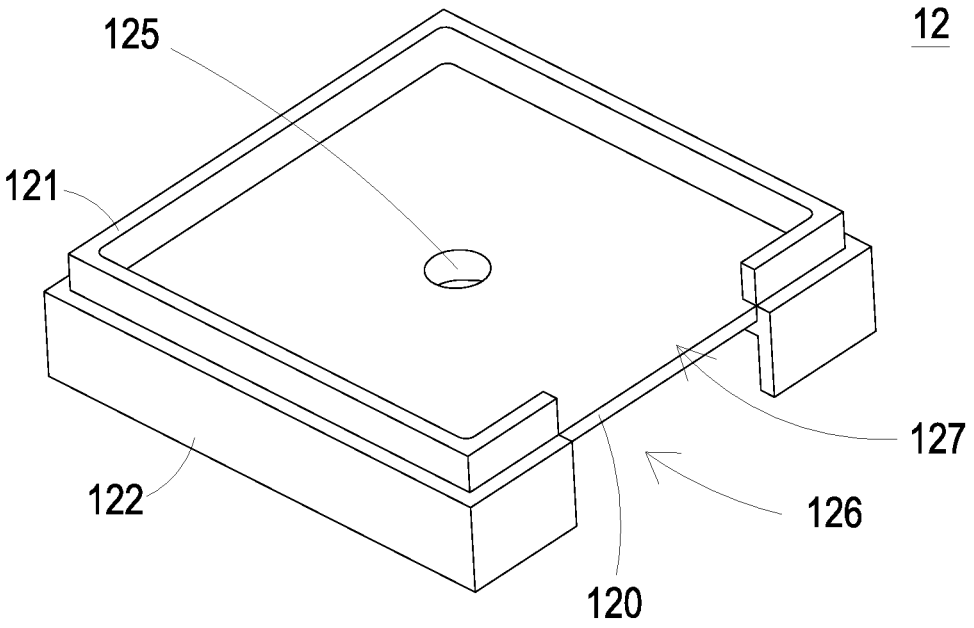
FIG. 3A is a schematic perspective view illustrating the flow-guiding pedestal of FIG. 1B and taken along a front side.
Figure 3B:
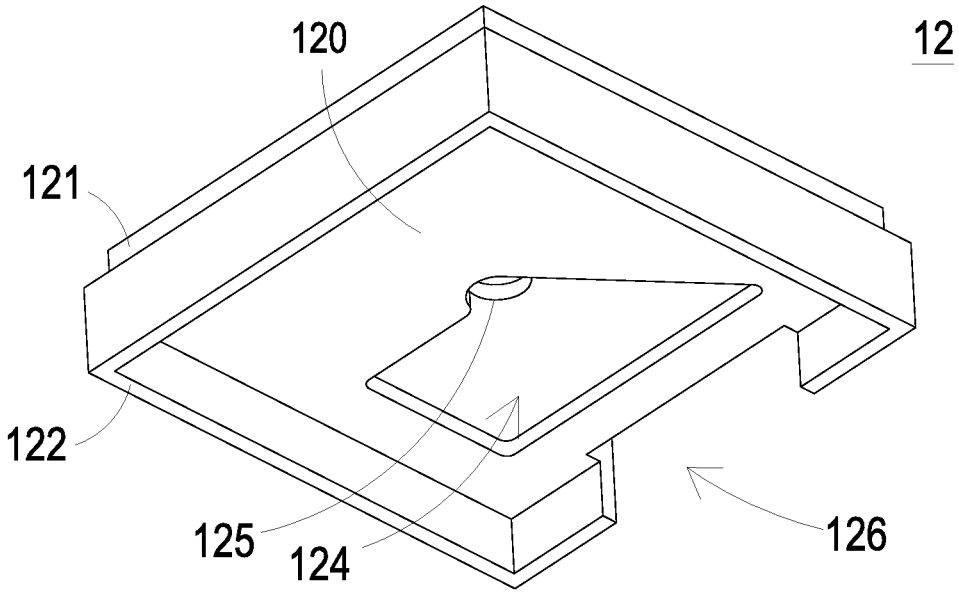
FIG. 3B is a schematic perspective view illustrating the flow-guiding pedestal of FIG. 3A and taken along a rear side.

Please refer to FIGS. 3A and 3B. The flow-guiding pedestal 12 includes a main plate 120, a protruding frame 121 and a chamber frame 122. The main plate 120 includes a recess 124 and a communicating aperture 125 in communication with the recess 124. The protruding frame 121 protrudes above and is arranged around a periphery of the main plate 120. The chamber frame 122 protrudes below and is arranged around the periphery of the main plate 120. In addition, a side length of the protruding frame 121 is smaller than a side length of the chamber frame 122, so that a profile of the protruding frame 121 on the main plate 120 would not match a profile of the chamber frame 122 on the main plate 120, and a stepped structure is formed around the periphery of the main plate 120, by which the gas outlet cover 11 can be engaged with the stepped structure and disposed on the flow-guiding pedestal 12. Moreover, the protruding frame 121 has an adhesive-injecting opening 127, and the chamber frame 122 has a pin opening 126.

Figure 5A:
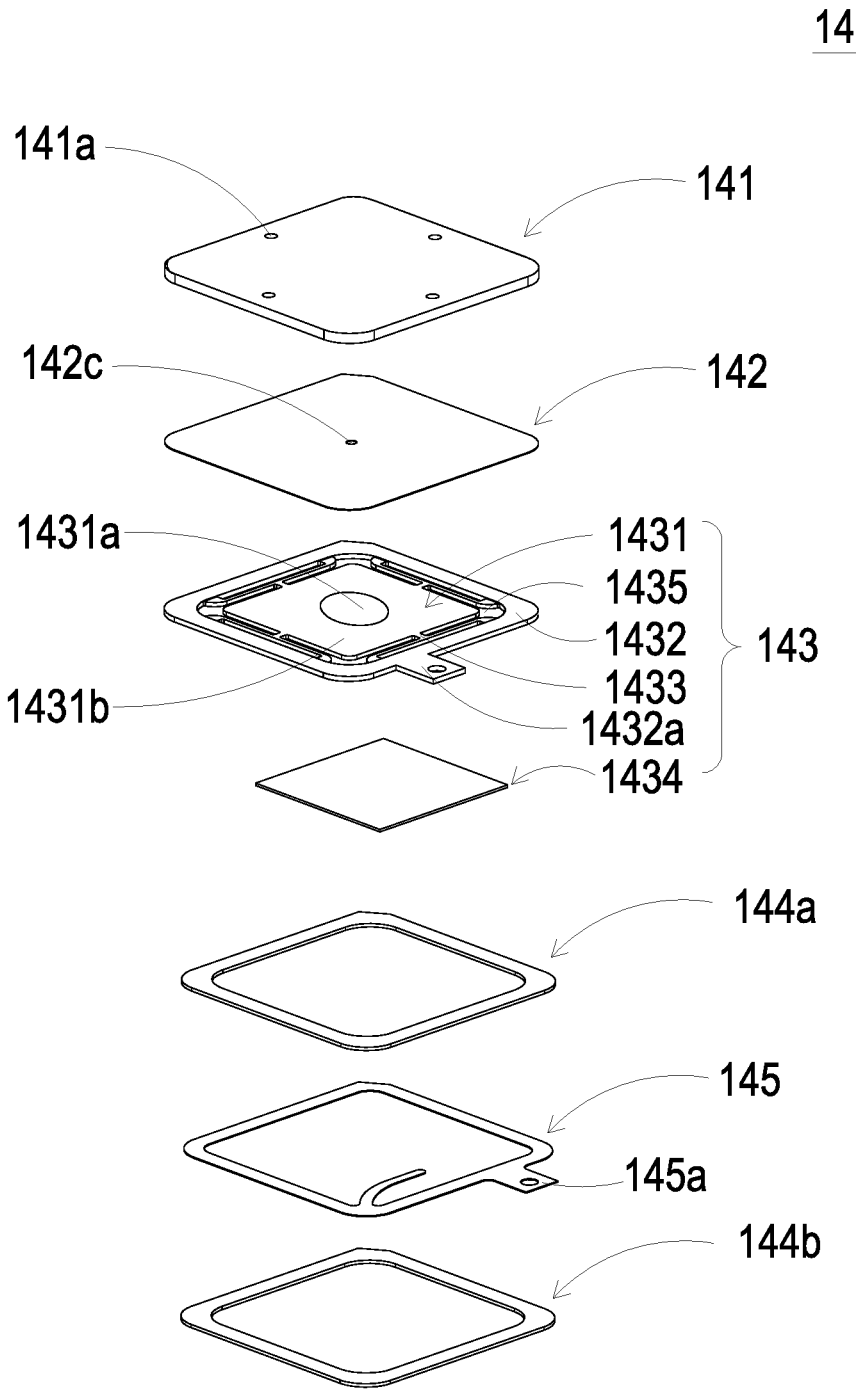
FIG. 5A is a schematic exploded view illustrating the gas pump according to the embodiment of the present disclosure and taken along a front side.
Figure 5B:
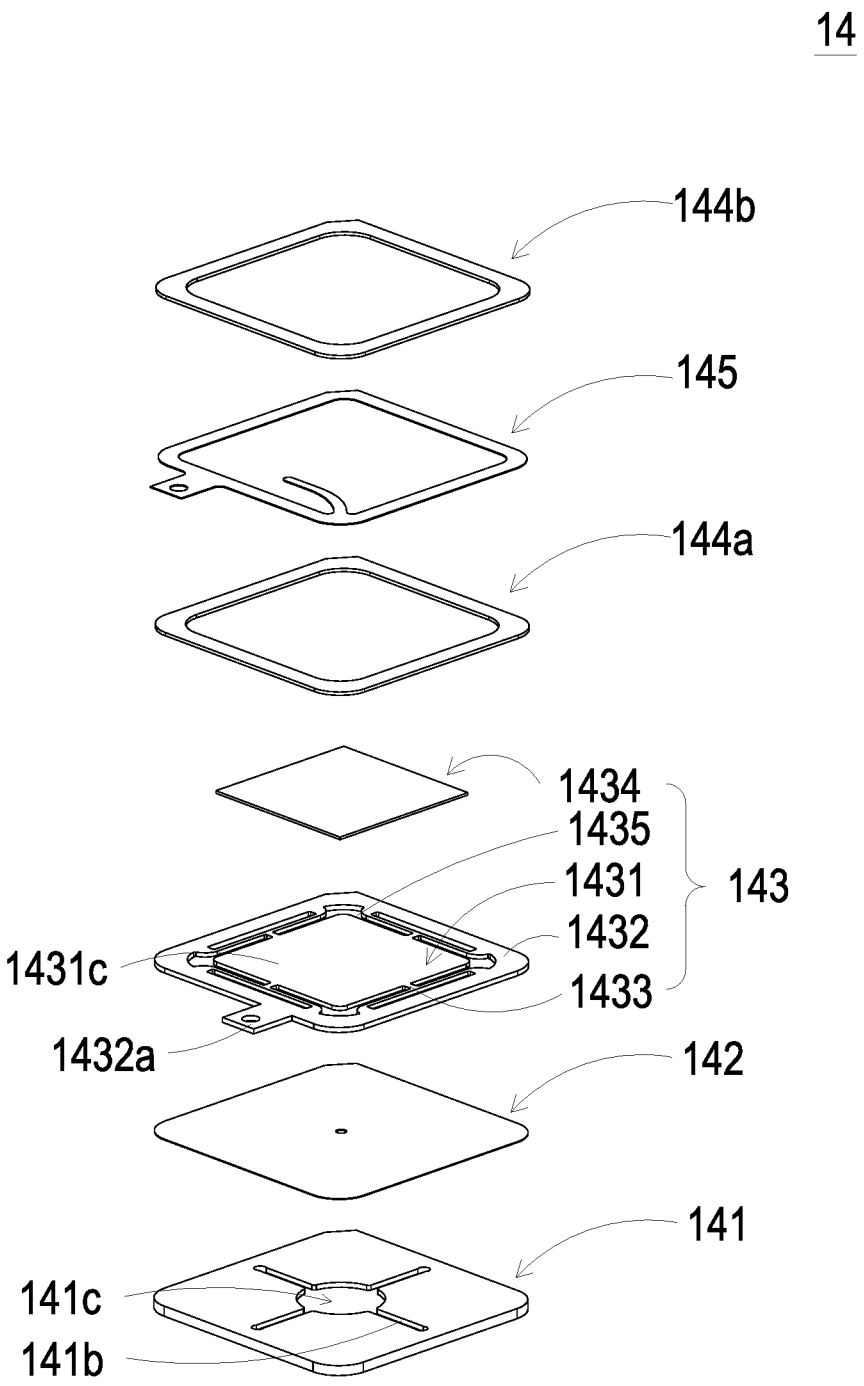
FIG. 5B is a schematic exploded view illustrating the gas pump according to the embodiment of the present disclosure and taken along a rear side.
Figure 6:
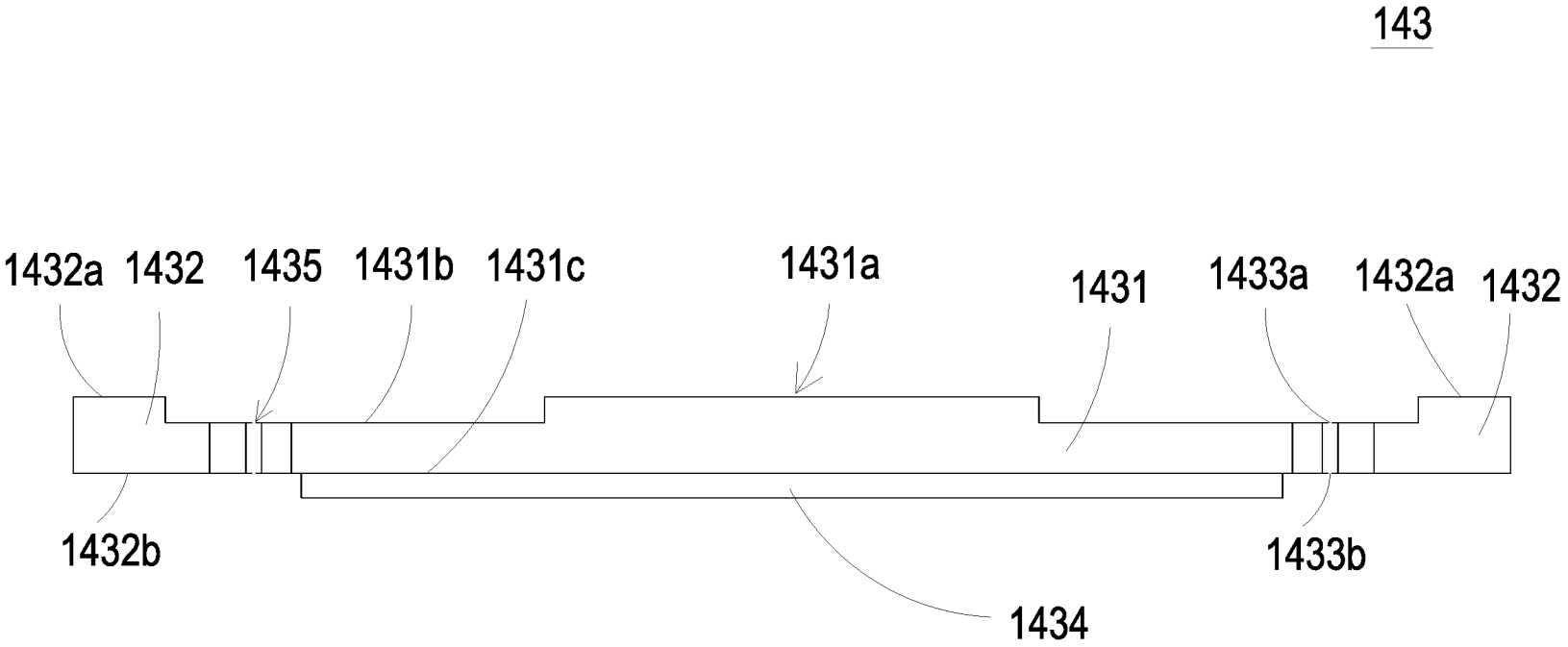
FIG. 6 is a schematic cross-sectional view illustrating the piezoelectric actuator of the gas pump as shown in FIG. 5A.

Please refer to FIGS. 5A, 5B and 6. The primary gas pump 14 and the secondary gas pump 15 have the same structures and are enabled to perform same actions. For describing briefly, only the structure of the primary gas pump 14 is described in the following descriptions. As shown in FIGS. 5A and 5B, the primary gas pump 14 includes a gas inlet plate 141, a resonance plate 142, a piezoelectric actuator 143, a first insulation plate 144*a*, a conducting plate 145 and a second insulation plate 144*b*, which are stacked on each other sequentially.

In this embodiment, the gas inlet plate 141 has plural inlets 141*a*, plural convergence channels 141*b* and a convergence cavity 141*c*. Preferably but not exclusively, the gas inlet plate 141 has four inlets 141*a* and four convergence channels 141*b*. The numbers of the inlets 141*a* and the convergence channels 141*b* may be varied according to the practical requirements. The inlets 141*a* are perforations penetrating the gas inlet plate 141, so that the gas can be introduced through the inlets 141*a* into the primary gas pump 14 in response to the action of the atmospheric pressure. The convergence channels 141*b* are spatially corresponding to the inlets 141*a*, respectively. The convergence cavity 141*c* is disposed at the intersection of the convergence channels 141*b* and is in communication with the convergence channels 141*b*, such that the gas from the inlets 141*a* would be guided along the convergence channels 141*b* and is converged in the convergence cavity 141*c*. Consequently, the gas can be transported by the primary gas pump 14. In this embodiment, the gas inlet plate 141 is integrally formed from one piece, but not limited thereto.

In this embodiment, the resonance plate 142 is a sheet made of a flexible material and has a central aperture 142*c*. The central aperture 142*c* is spatially corresponding to the convergence cavity 141*c* of the gas inlet plate 141, thereby allowing the gas to flow therethrough. In other embodiment, the resonance plate 142 may be, for example, made of copper, but not limited thereto.

In this embodiment, the piezoelectric actuator 143 includes a suspension plate 1431, an outer frame 1432, plural brackets 1433 and a piezoelectric element 1434. The piezoelectric actuator 143 has four brackets 1433, but not limited thereto. The number of the brackets 1433 may be varied according to the practical requirements. In this embodiment, the suspension plate 1431 includes a bulge 1431*a*, a first surface 1431*c* and a second surface 1431*b*. The bulge 1431*a* is disposed on the second surface 1431*b* and can be for example but not limited to a circular convex structure. In this embodiment, the outer frame 1432 is a frame structure and is arranged around a periphery of the suspension plate 1431. The brackets 1433 are connected between the outer frame 1432 and the suspension plate 1431 for elastically supporting the suspension plate 1431. Plural vacant spaces 1435 are defined among the brackets 1433, the outer frame 1432 and the suspension plate 1431 and are used to allow the gas to flow through. In this embodiment, the type and the number of the suspension plate 1431, the outer frame 1432 and the brackets 1433 are not limited and may be varied according to the practical requirements. In this embodiment, the outer frame 1432 includes a first conducting pin 1432*c* protruding outwardly therefrom and used to connect an external power device (not shown) with the primary gas pump 14 so as to receive a driving power, but not limited thereto. In this embodiment, the piezoelectric element 1434 is attached on the first surface 1431*c* of the suspension plate 1431. In response to an applied voltage, the piezoelectric element 1434 drives the suspension plate 1431 to bend and vibrate in vertical direction V (shown in FIGS. 8A to 8E), thereby transporting the gas. The actions of the primary gas pump 14 are described in the following paragraphs.

As shown in FIG. 6, a top surface of the bulge 1431*a* of the suspension plate 1431 is coplanar with a second surface 1432*a* of the outer frame 1432, while the second surface 1431*b* of the suspension plate 1431 is coplanar with a second surface 1433*a* of the bracket 1433. Moreover, there is a specific depth from the bulge 1431*a* of the suspension plate 1431 (or the second surface 1432*a* of the outer frame 1432) to the second surface 1431*b* of the suspension plate 1431 (or the second surface 1433*a* of the bracket 1433). A first surface 1431*c* of the suspension plate 1431, a first surface 1432*b* of the outer frame 1432 and a first surface 1433*b* of the bracket 1433 are coplanar with each other. The piezoelectric element 1434 is attached on the first surface 1431*c* of the suspension plate 1431. In some other embodiments, the suspension plate 1431 may be a square plate structure with two flat surfaces, but the type of the suspension plate 1431 may be varied according to the practical requirements. In this embodiment, the suspension plate 1431, the brackets 1433 and the outer frame 1432 may be integrally formed from a metal plate (e.g., a stainless steel plate). In an embodiment, the length of a side of the piezoelectric element 1434 is smaller than the length of a side of the suspension plate 1431. In another embodiment, the length of a side of the piezoelectric element 1434 is equal to the length of a side of the suspension plate 1431. Similarly, the piezoelectric element 1434 is a square plate structure corresponding to the suspension plate 1431 in terms of design.

In this embodiment, the primary gas pump 14 includes the first insulation plate 144*a*, the conducting plate 145 and the second insulation plate 144*b*, which are stacked on each other sequentially and located under the first surface 1432*b* of the outer frame 1432 of the piezoelectric actuator 143. The profiles of the first insulation plate 144*a*, the conducting plate 145 and the second insulation plate 144*b* substantially match the profile of the outer frame 1432 of the piezoelectric actuator 143. In some embodiments, the first insulation plate 144*a* and the second insulation plate 144*b* may be made of an insulating material, for example but not limited to a plastic material, so as to provide insulating efficacy. In other embodiments, the conducting plate 145 may be made of an electrically conductive material, for example but not limited to a metallic material, so as to provide electrically conducting efficacy. In this embodiment, the conducting plate 145 may have a second conducting pin 145*a* disposed thereon for electrical connection.

Figure 7:
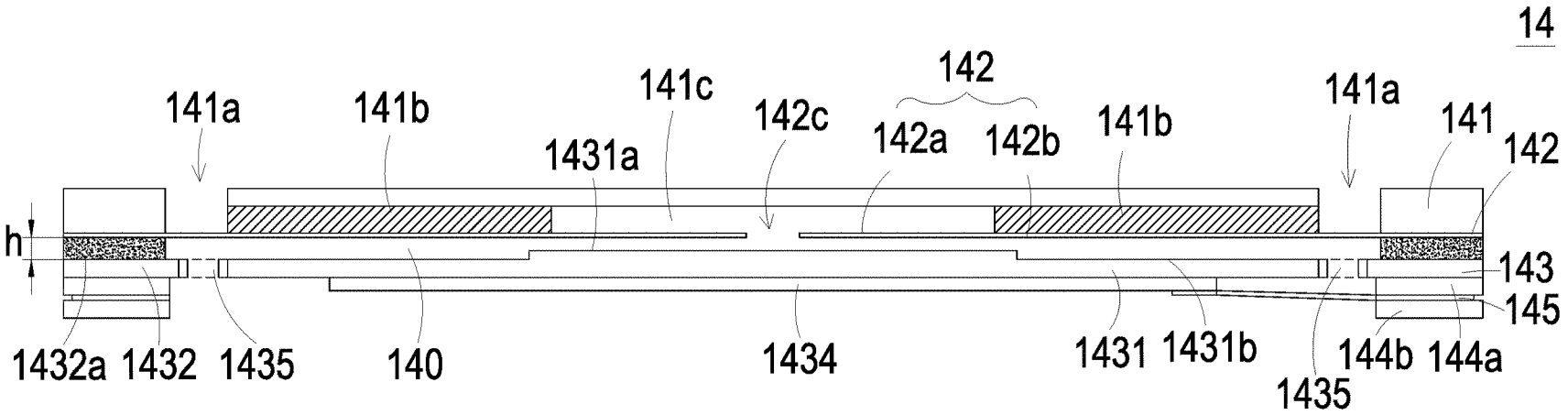
FIG. 7 is a schematic cross-sectional view illustrating the gas pump according to the embodiment of the present disclosure.

Please refer to FIG. 7. In an embodiment, the gas inlet plate 141, the resonance plate 142, the piezoelectric actuator 143, the first insulation plate 144*a*, the conducting plate 145 and the second insulation plate 144*b* of the primary gas pump 14 are stacked on each other sequentially. Moreover, there is a gap h between the resonance plate 142 and the outer frame 1432 of the piezoelectric actuator 143. In this embodiment, the gap h between the resonance plate 142 and the outer frame 1432 of the piezoelectric actuator 143 may be filled with a filler, for example but not limited to a conductive adhesive, so that a depth from the resonance plate 142 to the bulge 1431*a* of the suspension plate 1431 of the piezoelectric actuator 143 can be maintained. The gap h ensures the proper distance between the resonance plate 142 and the bulge 1431*a* of the suspension plate 1431 of the piezoelectric actuator 143, so that the gas can be transported rapidly, the contact interference is reduced and the generated noise is largely reduced. In some embodiments, alternatively, the height of the outer frame 1432 of the piezoelectric actuator 143 is increased, so that a gap is formed between the resonance plate 142 and the piezoelectric actuator 143, but the present disclosure is not limited thereto.

After the gas inlet plate 141, the resonance plate 142 and the piezoelectric actuator 143 are combined together, a movable part 142*a* and a fixed part 142*b* of the resonance plate 142 are defined. The movable part 142*a* is around the central aperture 142*c*. A chamber for converging the gas is defined by the movable part 142*a* of the resonance plate 142 and the gas inlet plate 141 collaboratively. Moreover, a compressing chamber 140 is defined by the gap h between the resonance plate 142 and the piezoelectric actuator 143 for temporarily storing the gas. Through the central aperture 142*c* of the resonance plate 142, the compressing chamber 140 is in communication with the chamber formed within the convergence cavity 141*c* of the gas inlet plate 141.

Figure 1B:
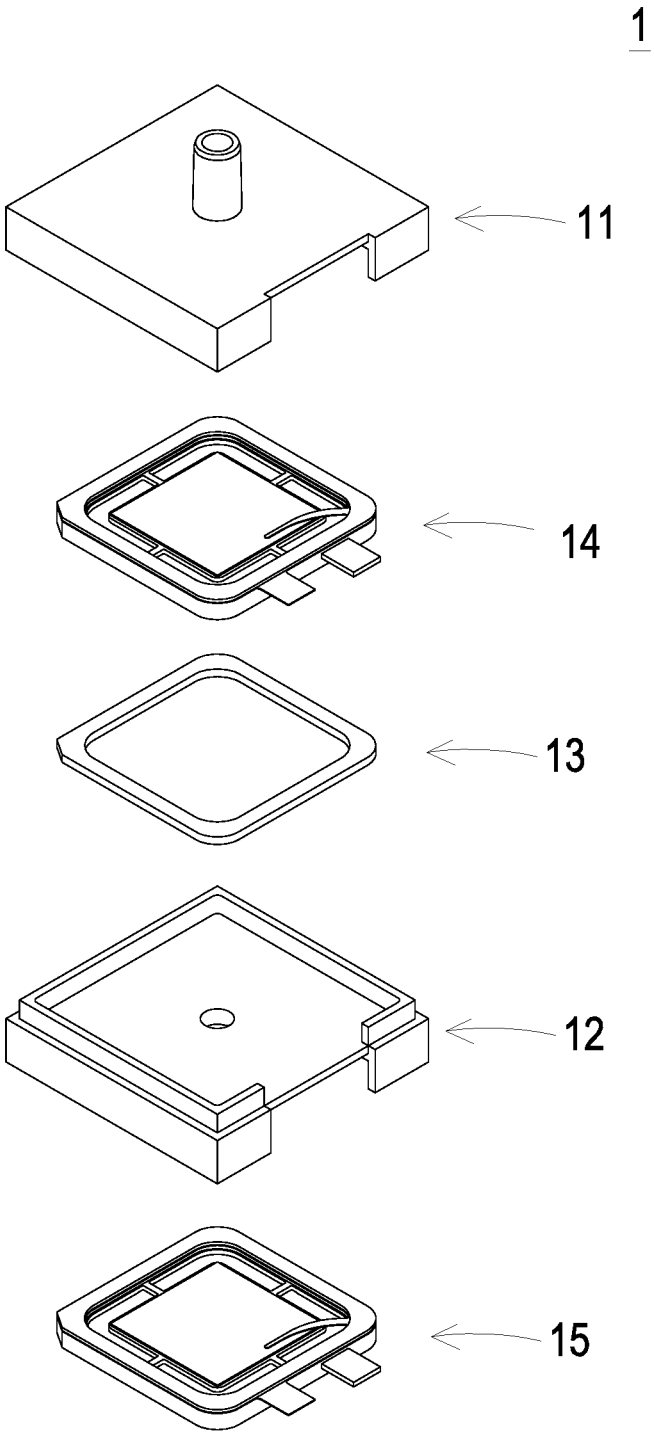
FIG. 1B is a schematic exploded view illustrating the gas transportation device according to the embodiment of the present disclosure.
Figure 4:
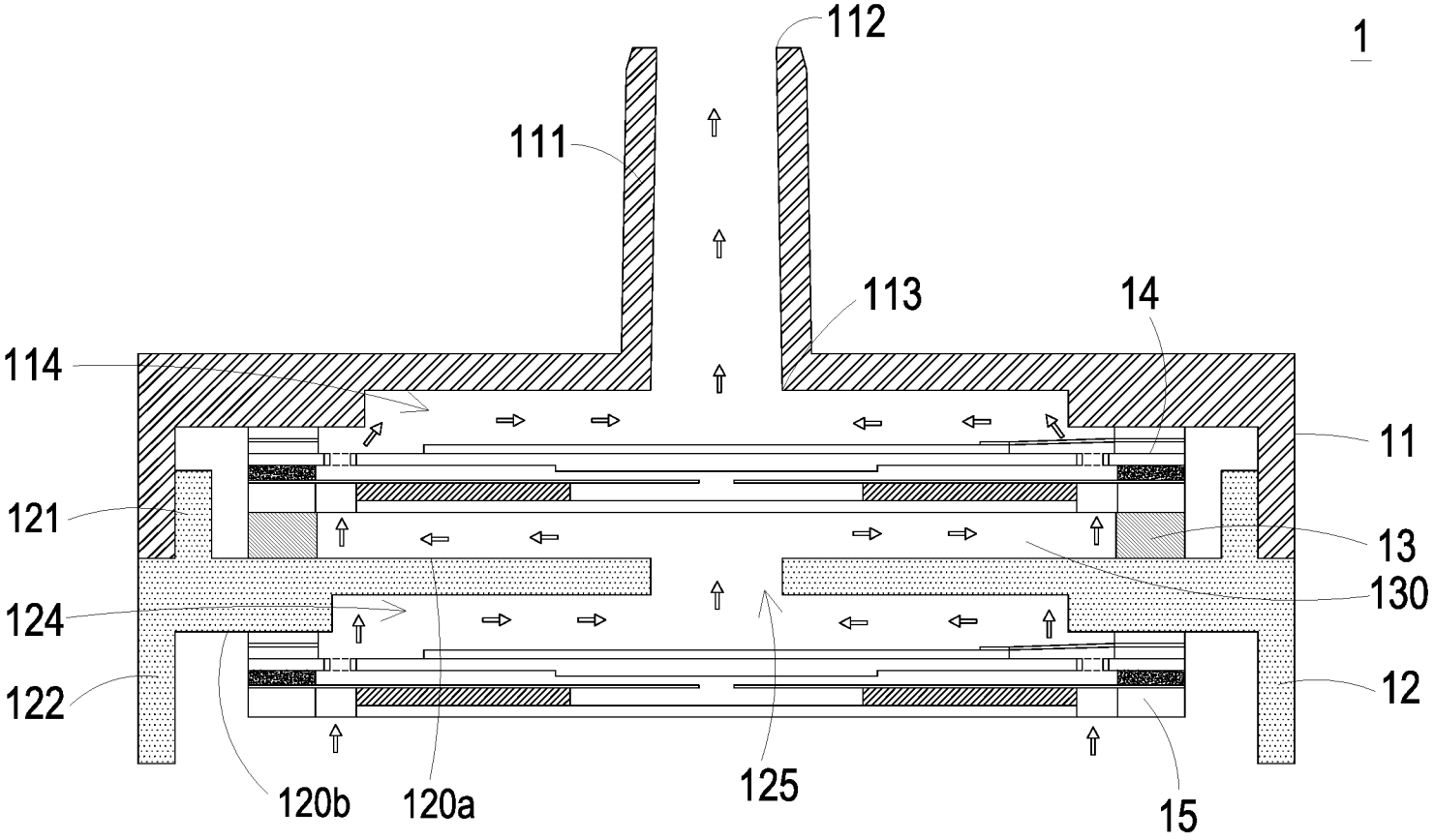
FIG. 4 is a schematic cross-sectional view illustrating the gas transportation device of FIG. 1A and taken along the line A-A.

Please refer to FIGS. 1A, 1B and 4. The primary gas pump 14 is disposed in the protruding frame 121 of the flow-guiding pedestal 12, and the first conducting pin 1432*a* and the second conducting pin 145*a* of the primary gas pump 14 protrude out from the pin opening 117 of the gas outlet cover 11. The second gas pump 15 is disposed in the chamber frame 122 of the flow-guiding pedestal 12, and the first conducting pin 1432*a* and the second conducting pin 145*a* of the secondary gas pump 15 protrude out from the pin opening 126 of the chamber frame 122 of the flow-guiding pedestal 12. Consequently, the external power device (not shown) can be electrically connected to the primary gas pump 14 and the second gas pump 15 for providing driving power. The adhesive film 13 has a hollow structure and is disposed between the primary gas pump 14 and the flow-guiding pedestal 12. The hollow structure defines the convergence chamber 130 in communication with the communicating apertures 125. The gas outlet cover 11 is assembled with the flow-guiding pedestal 12 by engaging with the stepped structure around the protruding frames 121, by which the gas outlet cover 11 is closely connected to the protruding frames 121 of the flow-guiding pedestal 12. Besides, an adhesive may be injected through the adhesive-injecting opening 127 of the protruding frame 121 so as to achieve the sealing and airtight efficacy. As described above, owing to the particular design of the protruding frame 121, the flow-guiding pedestal 12 and the gas outlet cover 11 are closely connected to each other. Consequently, the elements of the gas transportation device 1 can be assembled and disassembled easily that the time spent on assembling the components can be largely reduced, and the efficacy of easily replacing the elements can be achieved, so that the flexibility of utilizing the gas transportation device 1 is increased.

While the primary gas pump 14 and the secondary gas pump 15 are enabled to transport the gas, the gas is introduced into the recess 124 of the flow-guiding pedestal 12 via the secondary gas pump 15 and then is transported to the interior of the primary gas pump 14 through the communicating aperture 125 and the convergence chamber 130 sequentially. The gas is further transported to the gas outlet cavity 114 via the primary gas pump 14, and finally is discharged out from the discharging opening 112 of the gas outlet nozzle 111. In other words, in this embodiment, the primary gas pump 14 and the secondary gas pump 15 are stacked on each other and are enabled to transport gas simultaneously, so that the pressure of gas transportation of the gas transportation device 1 is more than single gas pump. Consequently, the efficacy of transporting gas at high pressure is achieved. Certainly, the number of the gas pumps to be stacked together is not limited to two and may be varied according to the practice requirements.

Figure 8A:
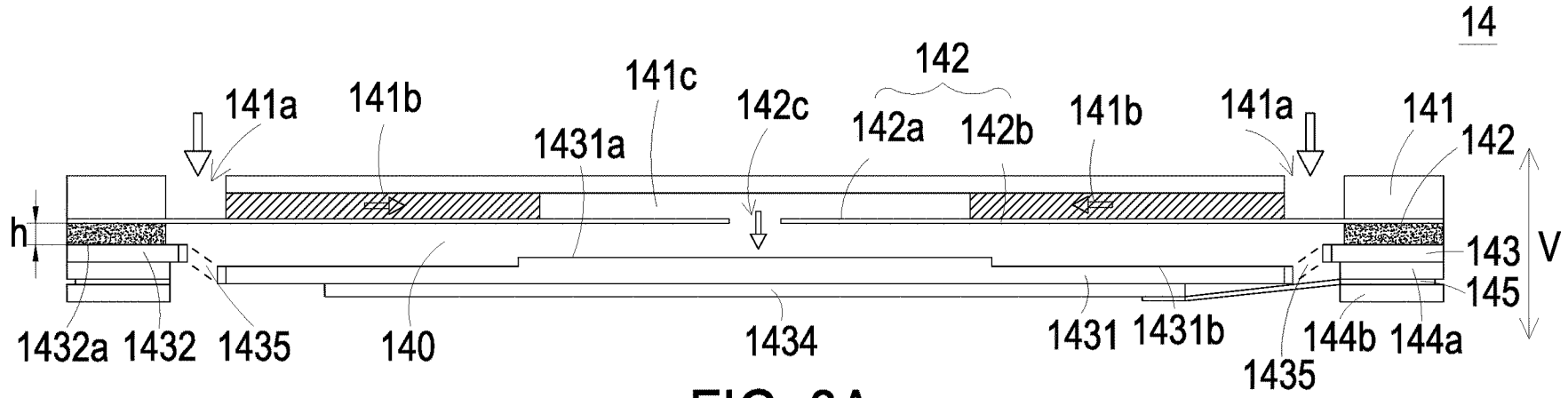
FIGS. 8A to 8E schematically illustrate the actions of the gas pump according to the embodiment of the present disclosure.
Figure 8B:
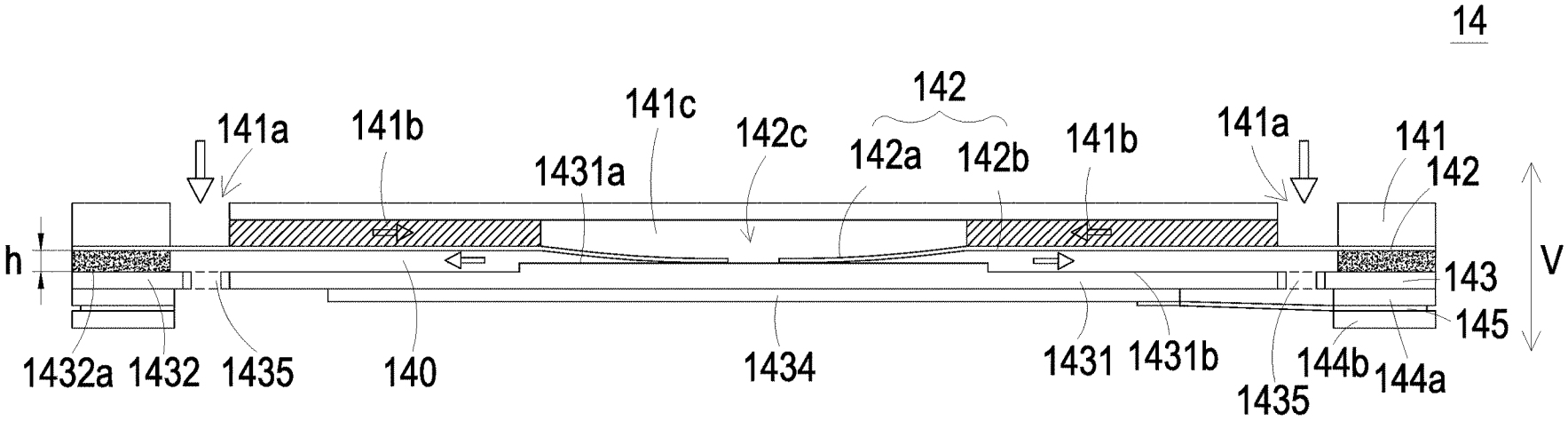
Figure 8C:
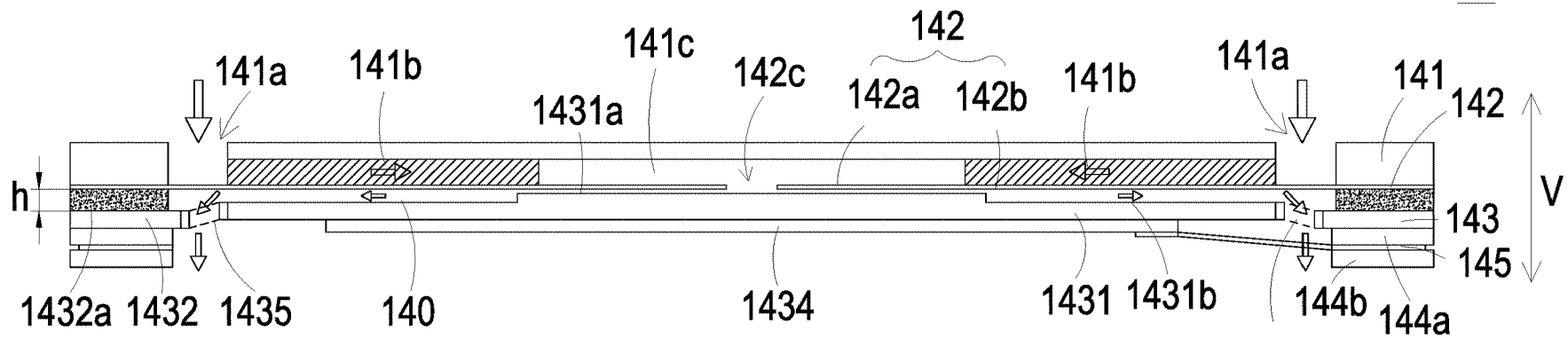
Figure 8D:
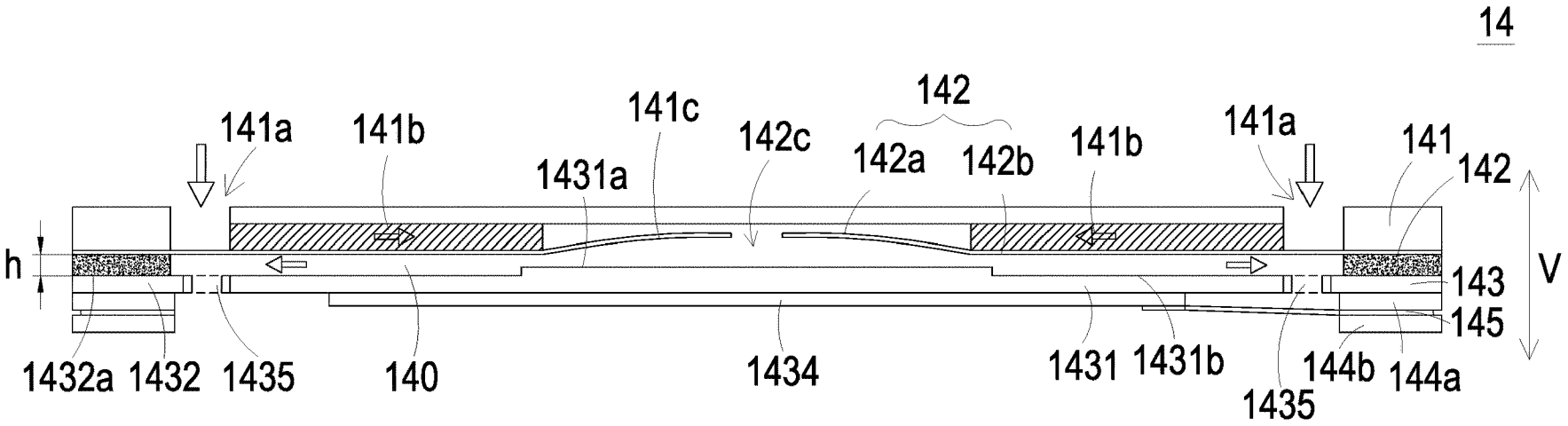
Figure 8E:
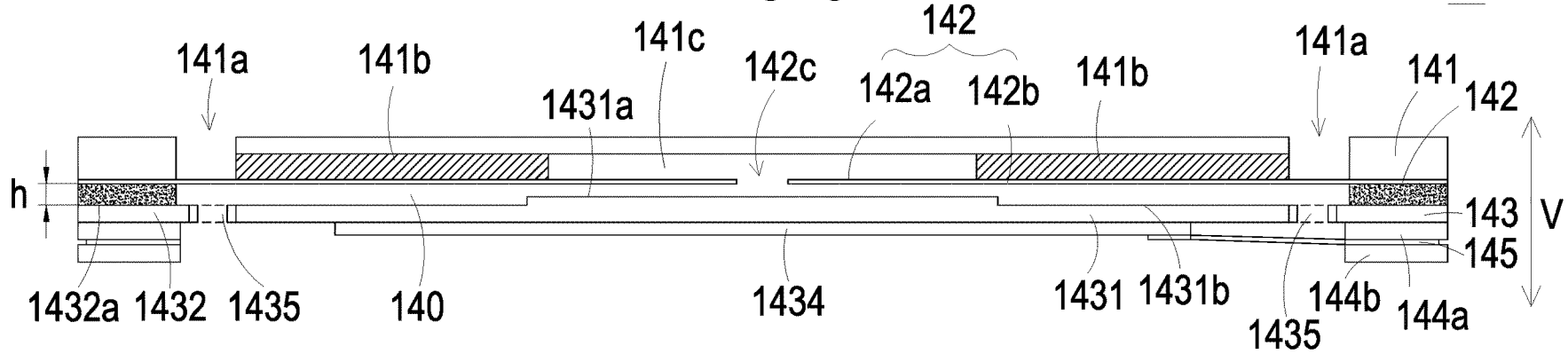

Please refer to FIGS. 8A to 8E. When the primary gas pump 14 is enabled, in response to an applied voltage, the piezoelectric actuator 143 vibrates along the vertical direction V in the reciprocating manner by using the bracket 1433 as the fulcrum. Firstly, as shown in FIG. 8A, when the piezoelectric actuator 143 vibrates along a first direction of the vertical direction V in response to the applied voltage, the volume of the compressing chamber 140 is enlarged, and the pressure in the compressing chamber 140 is decreased. As a result, the gas is introduced into the primary gas pump 14 through the inlets 141*a* in response to the action of the atmospheric pressure and is transported to the compressing chamber 140 through the convergence channels 141*b*, the convergence cavity 141*c* and the central aperture 142*c* sequentially. Then, as shown in FIG. 8B, since the resonance plate 142 is light and thin, when the gas is transported to the compressing chamber 140 in response to the action of the atmospheric pressure, the movable part 142*a* of the resonance plate 142 moves along the first direction to contact and attach on the bulge 1431*a* of the suspension plate 1431 of the piezoelectric actuator 143, and a distance from the fixed part 142*b* of the resonance plate 142 to a region of the suspension plate 1431 except the bulge 1431*a* remains the same. Owing to the deformation of the resonance plate 142 described above, the volume of the compressing chamber 140 is compressed and a middle communication space of the compressing chamber 140 is closed. Under this circumstance, the pressure gradient occurs to push the gas in the compressing chamber 140 to move toward the peripheral regions of the compressing chamber 140 and to flow through the vacant spaces 1435 of the piezoelectric actuator 143 along the first direction. Referring to FIG. 8C, the movable part 142*a* of the resonance plate 142 returns to its original position when the piezoelectric actuator 143 deforms along a second direction of the vertical direction V during vibration in response to the applied voltage. Consequently, the volume of the compressing chamber 140 is continuously compressed to generate the pressure gradient which makes the gas in the compressing chamber 140 continuously pushed toward the peripheral regions. Meanwhile, the gas is continuously fed into the inlets 141*a* of the gas inlet plate 141, and is transported to the chamber formed within the convergence cavity 141*c*. Then, as shown in FIG. 8D, the resonance plate 142 moves along the second direction, which is in resonance with the vibration of the piezoelectric actuator 143 along the second direction. That is, the movable part 142*a* of the resonance plate 142 also vibrates along the second direction. Consequently, it decreases the flow of the gas transported from the inlets 141*a* of the gas inlet plate 141 into the chamber formed within the convergence cavity 141*c*. At last, as shown in FIG. 8E, the movable part 142*a* of the resonance plate 142 returns to its original position. As the embodiments described above, when the resonance plate 142 vibrates along the vertical direction V in the reciprocating manner, the gap h between the resonance plate 142 and the piezoelectric actuator 143 is helpful to increase the maximum displacement along the vertical V direction during the vibration. In other words, the configuration of the gap h between the resonance plate 142 and the piezoelectric actuator 143 can increase the amplitude of vibration of the resonance plate 142.

Figure 9:
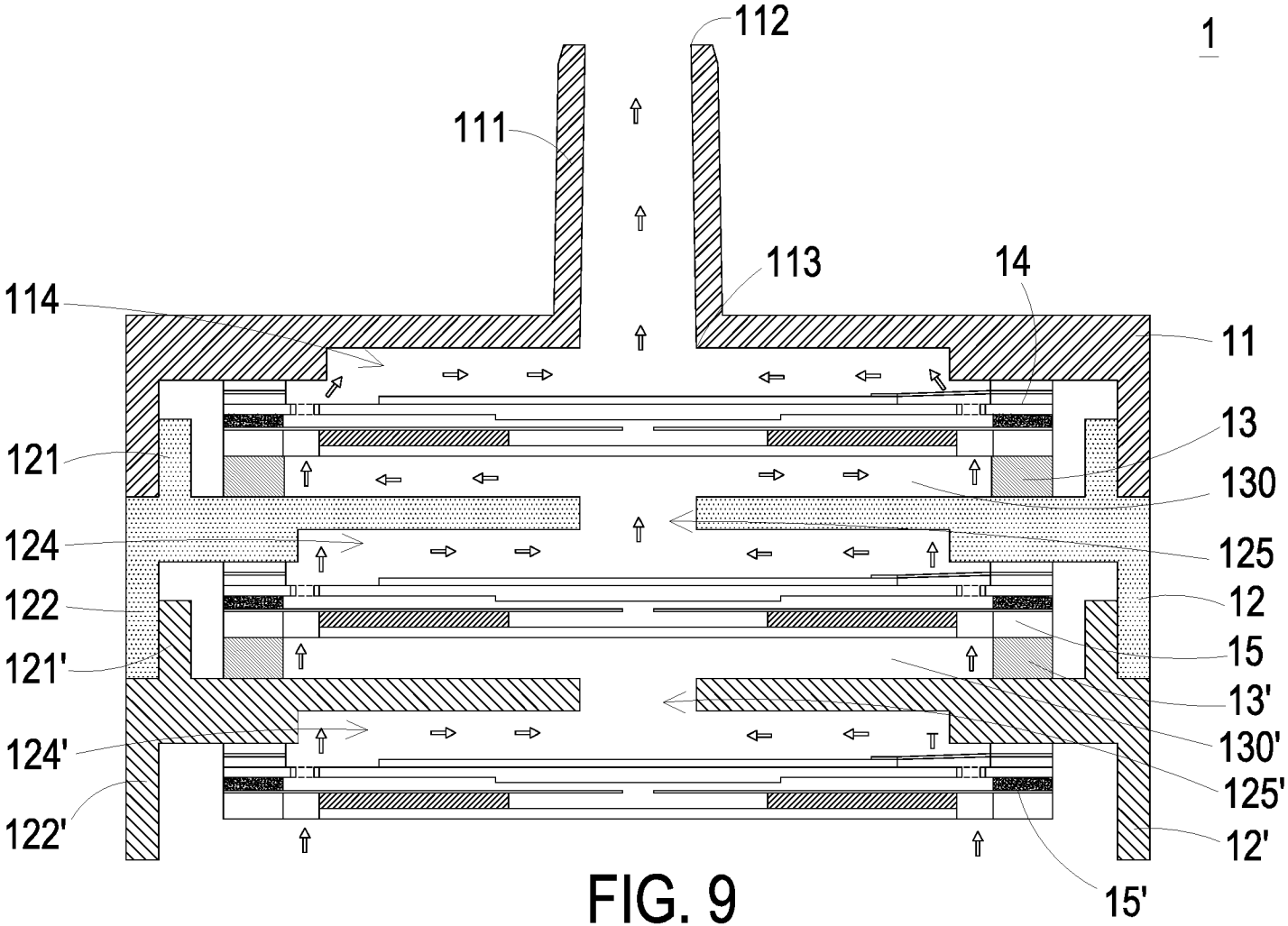
FIG. 9 is a schematic perspective view illustrating the gas transportation device according to another embodiment of the present disclosure.

Please refer to FIG. 9. In other embodiment, the gas transportation device 1 further includes another flow-guiding pedestal 12, which is hereinafter referred to as a stacked flow-guiding pedestal 12', and includes another secondary gas pump 15, which is hereinafter referred to as a stacked gas pump 15'. As shown in FIG. 9, the stacked flow-guiding pedestal 12' also includes a protruding frame 121', a chamber frame 122', a communicating aperture 125' and a recess 124'. The structures of the stacked flow-guiding pedestal 12' and the stacked gas pump 15' are similar to that of the flow-guiding pedestal 12 and the secondary gas pump 15 as described above, and are not described in details herein. In this embodiment, the stacked flow-guiding pedestal 12' and the flow-guiding pedestal 12 are stacked on each other. The protruding frame 121' of the stacked flow-guiding pedestal 12' is assembled and sealed with the chamber frame 122 of the flow-guiding pedestal 12, so that the stacked flow-guiding pedestal 12' is in communication with the flow-guiding pedestal 12 through the communicating aperture 125'. The stacked gas pump 15' is disposed in the chamber frame 122' of the stacked flow-guiding pedestal 12'. In other words, in this embodiment, the primary gas pump 14, the secondary gas pump 15 and the stacked gas pump 15' are enabled to transport the gas simultaneously, thereby increasing the output pressure for transporting gas. By using the particular design of the flow paths within the gas outlet cover 11, the flow-guiding pedestal 12 and the stacked flow-guiding pedestal 12', the gas can be converged so that the efficacy of increasing the output pressure for transporting gas is achieved. In this embodiment, the gas transportation device 1 further includes another adhesive film 13, which is hereinafter referred to as a stacked adhesive film 13'. The stacked adhesive film 13' has a hollow structure for allowing the secondary gas pump 15 and the stacked flow-guiding pedestal 12' to be connected and fixed with each other. After the stacked adhesive film 13' is attached, the hollow structure defines a convergence chamber 130' in communication with the communicating aperture 125'. Therefore, the gas discharged out from the communicating aperture 125' is directly transported to the secondary gas pump 15 through the convergence chamber 130'. In that case, the gas is further converged so that the efficacy of increasing the output pressure for transporting gas is achieved.

In some other embodiments, the gas transportation device 1 includes more than two flow-guiding pedestals and more than two secondary gas pumps, and the number of the flow-guiding pedestals is equal to the number of the secondary gas pumps. Under this circumstance, each secondary gas pump is disposed in the corresponding one of the flow-guiding pedestal and can be stacked according to the method described in the above embodiment. Consequently, the output pressure of the gas transportation can be adjusted according to the practical requirements. By stacking the plural gas pumps and the plural flow-guiding pedestals, the efficacy of transporting gas at high pressure is achieved.

From the above descriptions, the present disclosure provides the gas transportation device. The gas pumps are disposed in the flow-guiding pedestals, respectively. The gas pumps are stacked on each other and are connected with the gas outlet cover. Consequently, the gas is converged by the internal flow paths of the assembled gas transportation device, so that the efficiency for transporting gas is enhanced. In addition, plural gas pumps are employed in the gas transportation device so that the efficacy of increasing the output pressure for transporting gas is achieved. Moreover, owing to the particular design of the sidewalls of both the flow-guiding pedestal and the gas outlet cover which are fastened to each other, the elements of the gas transportation device 1 can be assembled and disassembled easily. In this way, the time spent on assembling the components can be largely reduced and the efficacy of easily replacing the elements can be achieved. In addition, owing to the particular design of flow paths and structures in the gas pump, the gas can be transported in high speed and with high efficiency. Furthermore, the silent and miniature efficacy is also achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gas transportation device, comprising:

a gas outlet cover having a gas outlet nozzle and a gas outlet cavity, wherein the gas outlet nozzle and the gas outlet cavity are in communication with and spatially corresponding to each other;

at least one flow-guiding pedestal, each of which has a main plate, a protruding frame and a chamber frame, wherein the main plate has a recess and a communicating aperture in communication with the recess, wherein the communicating aperture is opened in the center of the main plate and has a diameter smaller than a length of the recess;

a primary gas pump and at least one secondary gas pump, wherein the primary gas pump is disposed in the protruding frame of the flow-guiding pedestal, and the secondary gas pump is disposed in the chamber frame of the flow-guiding pedestal, wherein the length of the recess is smaller than a length of the secondary pump, and the secondary pump seals the periphery of the recess; and at least one adhesive film having a hollow structure and disposed between the primary gas pump and the flow-guiding pedestal, wherein the hollow structure defines a convergence chamber in communication with the communicating aperture, wherein the gas outlet cover covers and seals the flow-guiding pedestal so as to be connected to the protruding frame of the flow-guiding pedestal, wherein while the primary gas pump and the secondary gas pump are enabled to transport gas simultaneously, the gas is introduced into the recess of the flow-guiding pedestal, is transported to the primary gas pump through the communicating aperture and the convergence chamber sequentially, is transported to the gas outlet cavity via the primary gas pump, and finally is discharged out from the gas outlet nozzle.

2. The gas transportation device according to claim 1, wherein the gas outlet nozzle is in a conical shape having a larger end and a smaller end that the gas outlet nozzle is gradually tapered from the larger end to the smaller end, and has interior diameters gradually decreased from the larger end to the smaller end.

3. The gas transportation device according to claim 1, wherein the protruding frame protrudes above and is arranged around a periphery of the main plate, the chamber frame protrudes below and is arranged around the periphery of the main plate, and a side length of the protruding frame is smaller than a side length of the chamber frame so that a stepped structure is formed, whereby the gas outlet cover is engaged with the stepped structure and disposed on the flow-guiding pedestal.

4. The gas transportation device according to claim 1, wherein the flow-guiding pedestal has an adhesive-injecting opening and a pin opening.

5. The gas transportation device according to claim 1, wherein the at least one flow-guiding pedestal includes a stacked flow-guiding pedestal, the at least one secondary gas pump includes a stacked gas pump, and the at least one adhesive film includes a stacked adhesive film, wherein the stacked flow-guiding pedestal is stacked below the flow-guiding pedestal in which the primary gas pump is disposed, the secondary gas pump is in communication with the stacked flow-guiding pedestal by using the stacked adhesive film, and the stacked gas pump is disposed under the stacked flow-guiding pedestal, so that the primary gas pump and the plural secondary gas pumps are stacked on and in communication with each other to form the gas transportation device.

6. The gas transportation device according to claim 1, wherein each of the primary gas pump and the secondary gas pump is a piezoelectric gas pump and comprises:

a gas inlet plate having at least one inlet, at least one convergence channel and a convergence cavity;

a resonance plate having a central aperture;

a piezoelectric actuator comprising a piezoelectric element, a suspension plate, an outer frame, at least one bracket and a first conducting pin, wherein at least one vacant space is defined among the suspension plate, the outer frame and the at least one bracket, the suspension plate has a first surface and a second surface, a bulge is disposed on the second surface, and the piezoelectric element is attached on the first surface;

a first insulation plate;

a conducting plate comprising a second conducting pin; and a second insulation plate, wherein the gas inlet plate, the resonance plate, the piezoelectric actuator, the first insulation plate, the conducting plate and the second insulation plate are stacked sequentially, and a compressing chamber is defined by a gap between the resonance plate and the piezoelectric actuator, wherein in response to an applied voltage, the piezoelectric element drives the suspension plate to bend and vibrate in vertical direction in a reciprocating manner, whereby the gas is fed through the at least one inlet of the gas inlet plate and is transported to the compressing chamber through the convergence channel, the convergence cavity and the central aperture sequentially, and finally is directed to the recess through the at least one vacant space.

7. A gas transportation device, comprising:

at least one gas outlet cover having at least one gas outlet nozzle and at least one gas outlet cavity, wherein the gas outlet nozzle and the gas outlet cavity are in communication with and spatially corresponding to each other;

at least one flow-guiding pedestal, each of which has at least one main plate, at least one protruding frame and at least one chamber frame, wherein the main plate has at least one recess and at least one communicating aperture in communication with the recess, wherein the communicating aperture is opened in the center of the main plate and has a diameter smaller than a length of the recess;

at least one primary gas pump and at least one secondary gas pump, wherein the primary gas pump is disposed in the protruding frame of the flow-guiding pedestal, and the secondary gas pump is disposed in the chamber frame of the flow-guiding pedestal, wherein the length of the recess is smaller than a length of the secondary pump, and the secondary pump seals the periphery of the recess; and at least one adhesive film having at least one hollow structure and disposed between the primary gas pump and the flow-guiding pedestal, wherein the hollow structure defines at least one convergence chamber in communication with the communicating aperture, wherein the gas outlet cover covers and seals the flow-guiding pedestal so as to be connected to the protruding frame of the flow-guiding pedestal, wherein while the primary gas pump and the secondary gas pump are enabled to transport gas simultaneously, the gas is introduced into the recess of the flow-guiding pedestal, is transported to the primary gas pump through the communicating aperture and the convergence chamber sequentially, is transported to the gas outlet cavity via the primary gas pump, and finally is discharged out from the gas outlet nozzle.

* * * * *